US007237765B2

(12) United States Patent
Mateo Mur

(10) Patent No.: US 7,237,765 B2
(45) Date of Patent: Jul. 3, 2007

(54) SPEED LIMITING SYSTEM FOR LIFTING DEVICES

(75) Inventor: Francisco de Asis Mateo Mur, Pina de Ebro (ES)

(73) Assignee: Dynatech, Dynamics & Technology, S.L., Pina de Ebro (ES)

( * ) Notice: Subject to any disclaimer, the term of this patent is extended or adjusted under 35 U.S.C. 154(b) by 0 days.

(21) Appl. No.: 11/221,784

(22) Filed: Sep. 9, 2005

(65) Prior Publication Data

US 2007/0007499 A1 Jan. 11, 2007

(30) Foreign Application Priority Data

Jul. 8, 2005 (EP) ..... 05381035

(51) Int. Cl.
*B66D 1/50* (2006.01)

(52) U.S. Cl. ..... 254/274; 254/275; 188/181 A

(58) Field of Classification Search ..... 254/267, 254/274, 275; 188/180, 181 A
See application file for complete search history.

(56) References Cited

U.S. PATENT DOCUMENTS 4,402,470 A * 9/1983 Hamayasu ..... 242/286
4,493,479 A * 1/1985 Clark ..... 254/274
4,555,091 A * 11/1985 May et al. ..... 254/267
5,261,645 A * 11/1993 Huffman ..... 254/267
5,366,203 A * 11/1994 Huffman ..... 254/362

* cited by examiner

*Primary Examiner*—Emmanuel M Marcelo
(74) *Attorney, Agent, or Firm*—Birch, Stewart, Kolasch, & Birch, LLP

(57) ABSTRACT

Speed limiter system to detect over speed and generate a signal to cut the power and if necessary operate brakes. It consist of the limiter itself, with a tension pulley. The limiter consists of weights connected by a mechanism that moves asymmetrically and by centrifugal force when an over speed occurs to operate the lever of an electrical contact, with the possibility of remote resetting using the necessary means. On the other hand, the tension pulley provides sufficient tension to both sections of the cable via an adjustable compression spring or by means of weights suspended on an articulated arm, both transmitting sufficient tension to the tension pulley axle.

9 Claims, 7 Drawing Sheets

SPEED LIMITING SYSTEM FOR LIFTING DEVICES

OBJECT OF THE INVENTION

The purpose of this invention is a speed limiting system for lifting devices, especially for lifts.

The system that forms the subject of the invention is designed to detect excess speed of the cabin, in which case it sends an electrical signal to cut the current to the circuit and if necessary operates the lift's breaks. The system operates in both the ascending and descending directions.

The system in the invention consists of the speed limiter itself and a tension pulley that provides the necessary tension for the cables that run inside the throats of the pulleys that have means of detecting the excess speed.

A feature of this invention is the special layout and design of the elements that make up the system and the interaction between them, achieving a system that allows the automatic resetting from the exterior of the electrical parts that generate a signal to cut the power supply system using remote control means.

Therefore, this invention falls within the area of safety measures in lifting devices and especially in lifts, and specifically among excess speed limiting devices.

BACKGROUND TO THE INVENTION

Until now, the speed limiting devices in the market have complications arising from their unequal operation in both the ascending and descending directions, as well as a lack of regulation means that are sufficiently calibrated to select the speed at which the limiting system is to operate.

Another difficulty in some of the speed limiting systems is that, after they operate, it is necessary to reset them manually, which implies access to the limiting system.

In those cases in which speed limiting systems have means for resetting, these operate in one direction and they must be fitted with a means of resetting for each direction of operation.

Therefore, the purpose of this invention is to develop a speed limiting system that overcomes the above inconveniences, achieving a system that operates independently in both the ascending and descending directions and that allows adjustment in both the ascending and descending directions and in which it is not necessary to access the means on which the speed limiter operates to reset it, this being carried out remotely.

DESCRIPTION OF THE INVENTION

The speed limiting system that forms the subject of the invention consists of a main part which is the speed limiter itself and a tension pulley that provides the necessary tension to the cables running inside the throats.

The main part of the limiting system detects situations in which the cabin is moving at an excess speed, in both the ascending and descending directions, and sends an electrical signal to cut the current to the safety circuit and, if necessary, to operate the lift's brakes.

The limiter system is associated with means for remote resetting that allows the electrical parts operated by the limiter to return to their position, without the need for access to the interior of the cabin.

The limiter consists of two weights that pivot with respect to a fixed point, joined at their ends to an arm that pivots with respect to another fixed point, thus achieving the symmetrical movement of both weights.

When the rotational speed of the pulley on which the limiter is fitted exceeds a certain speed, the centrifugal force of the weights moves them outwards to operate an electrical contact.

The speed at which the limiter operates is adjustable, for which there is a mobile part joined to a tension screw that adjusts the tension on a spring on one of the weights, thus achieving the adjustment of the speed at which the electrical contact will be operated.

The speed at which the limiter operates is adjustable, for which there is a movable piece joined to a tension screw that adjusts the tension of a spring on one of the weights, thus achieving the adjustment of the speed at which the electrical contact is operated.

Next to the speed limiter there are means for resetting it that allow the return under remote control of the electrical parts to their normal position, once operated.

These means for resetting consist of a coil which, when supplied with a suitable current, attracts an axis so that it moves a plate that moves the lever of the electrical contact operated by the weights in their eccentric movement to return to its original position.

The reset system allows the lever to be returned to its position regardless of whether the lever has moved to the right or to the left, according to the rotational direction of the speed limiter.

Finally, the complementary part of the speed limiter system has a tension pulley that provides sufficient tension to each section of the lifting cable to allow the correct operation of the brakes.

The means by which the cable tension is changed is via the tension pulley, providing a load to the pulley axle. The load on the axle is supplied by a compression spring, adjustable by means of a screw, or using an articulated arm fixed to the pulley's axle with a series of weights on the end of the articulated arm.

In one case, the compression power of the spring is transmitted to the axle via a bracket to which the spring is fixed with a screw.

If there are weights hanging on the end of an arm to which the tension pulley axle is fixed, the necessary tension is transmitted to the tension pulley axle by means of the torque supplied by the weights hanging from the end of the articulated arm.

The tension pulley is anchored to the guide by a plate with lengthened holes to which the guide to support the flanges are coupled and which fix the tension system.

DESCRIPTION OF THE DRAWINGS

To complement the description and to provide a better understanding of the properties of the invention, this description is accompanied by a set of plans that form an integral part of it and that illustrate, but do not limit it, showing the following.

PREFERRED EMBODIMENT OF THE INVENTION

In view of the above-mentioned figures, the following describes a preferred embodiment of the invention as well as an explanation of the drawings.

The speed limiter system consists of the limiter itself and a tension pulley that provides a sufficient tension to the cable to ensure the correct operation of the brakes once the over speed is detected by the speed limiter.

Figure 1:
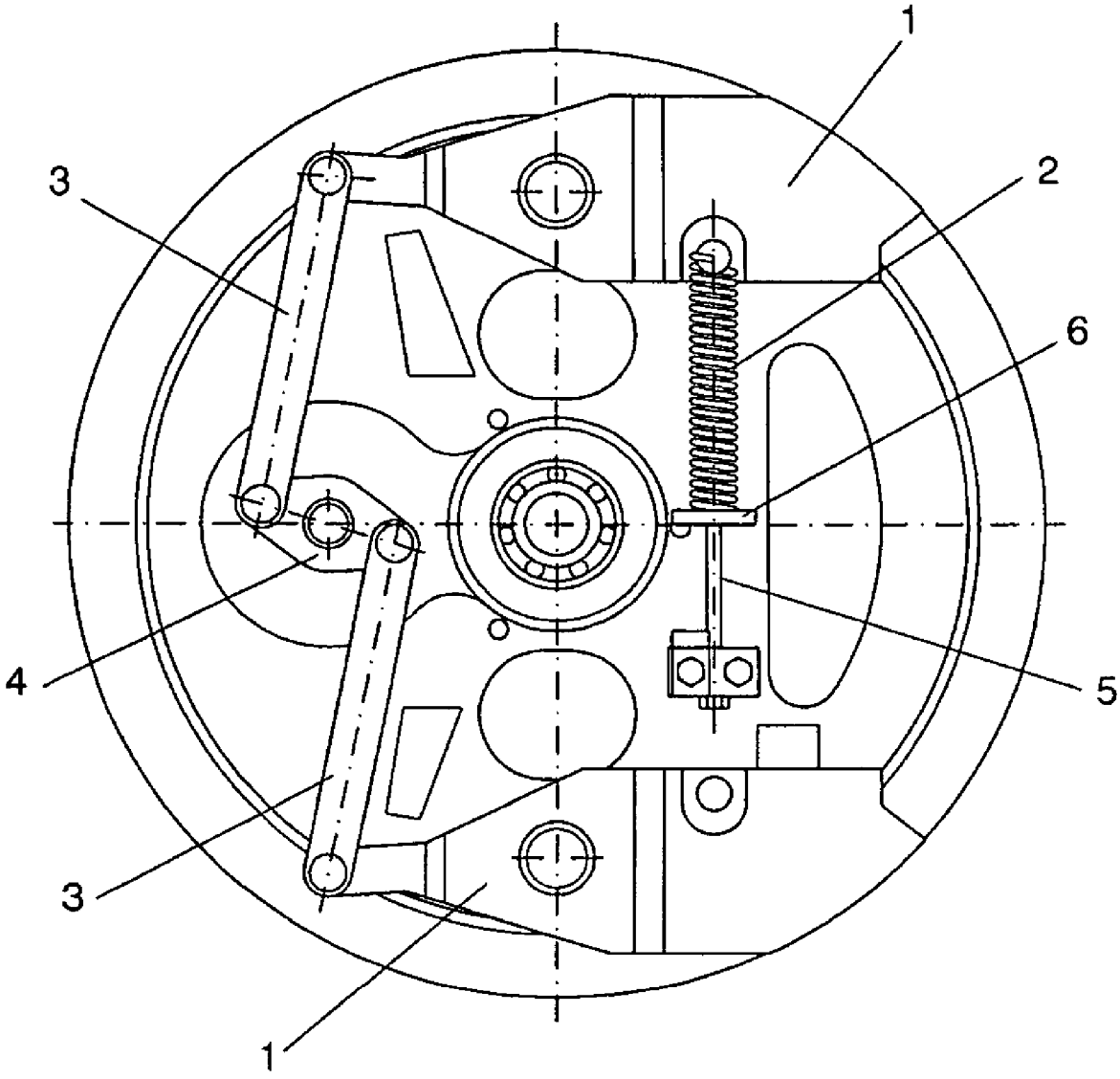
FIG. 1 shows the elements that make up the means of detecting the excess speed themselves.

FIG. 1 shows in detail the parts that make up the speed limiter itself, showing that this consists of two weights (1) that rotate with respect to a fixed point and that are joined by two articulated arms (3) joined by a junction arm (4) which rotates with respect to another fixed point. This guiding assembly ensures a synchronised movement of both weights.

In order to be able to adjust the centrifugal movement of the weights (1), a spring (2) is fixed to one of the weights at one of its ends while the other end is fixed to a mobile piece (6) that is adjusted by a tension screw (5).

The movable piece (6) is used to adjust the tension of the spring (2) and therefore the speed of the regulation since it alters the centrifugal movement of the weights (1). The more tension there is in the spring (2), the higher will be the speed at which the weights open and operate the electrical contacts.

Figure 2:
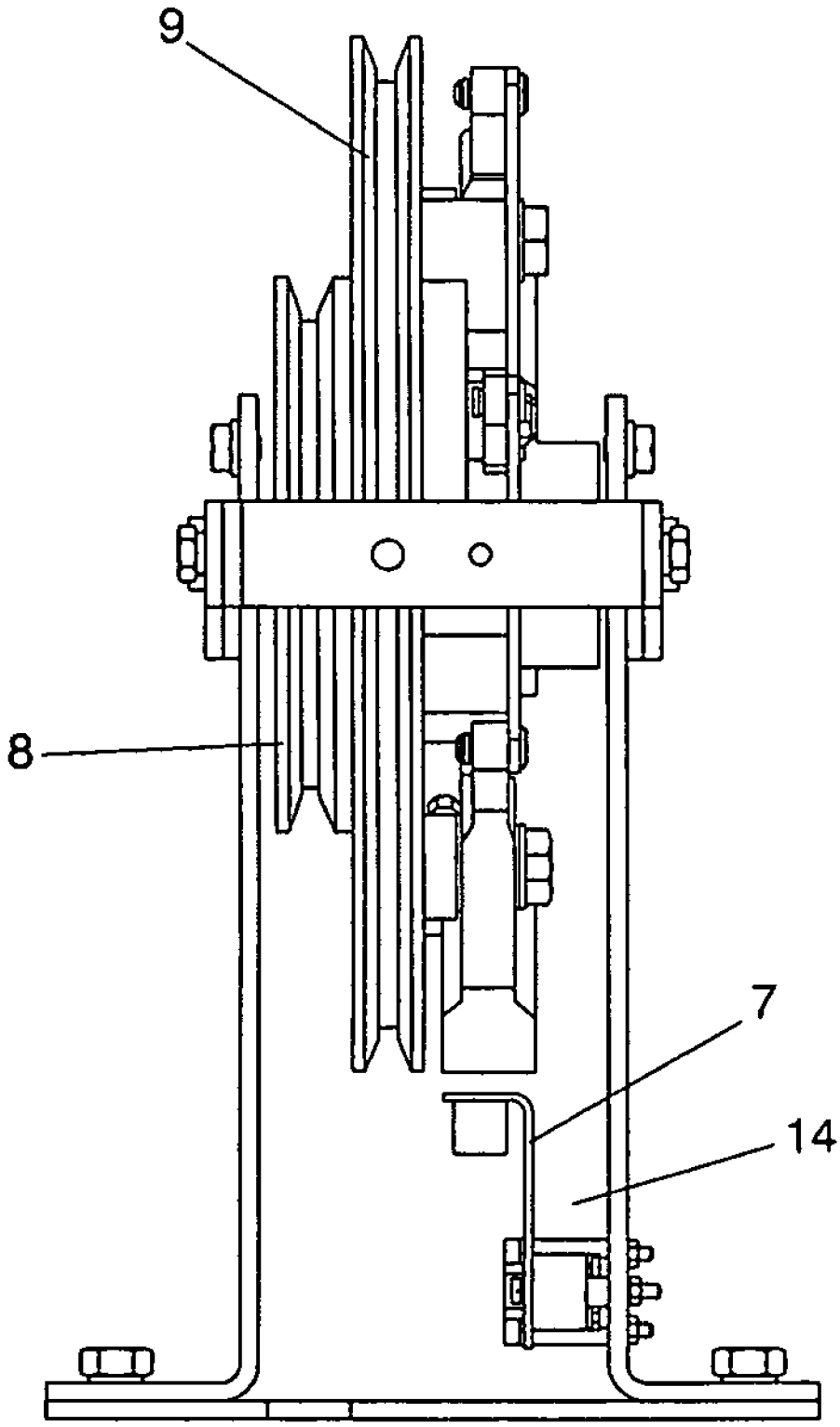
FIG. 2 is a side view of the speed limiter assembly and to which a check pulley is associated. It also shows the resetting assembly that returns the electrical pieces to their original position once operated by the limiter.

FIG. 2 shows the limiter assembly on which, in line with the pulley housed in the limiter, there is another pulley called the check pulley (8), which is used to check that the limiter system operates correctly since, because its diameter is smaller, its rotational speed is higher.

The remote resetting assembly (14) is fitted to the lower part of the speed limiter, with a lever (7) for the electrical contact.

Figure 3:
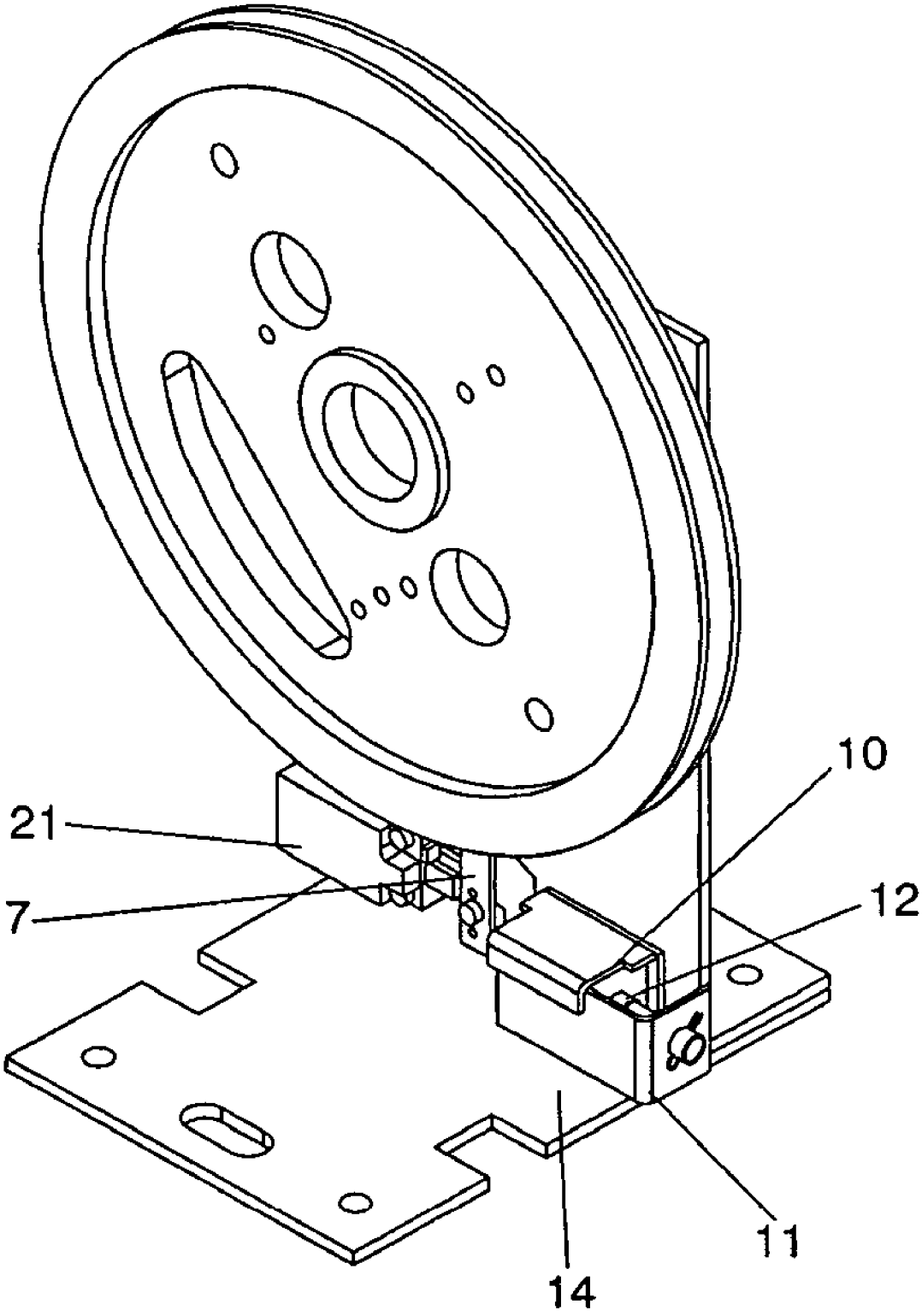
FIG. 3 is a perspective view of the remote resetting assembly together with the electrical parts and their layout in relation to the speed limiter.

FIG. 3 shows that the remote resetting assembly (14) consists is fixed to the immediately lower part of the limiter itself and supported on the same base, and has a coil (10) which, when powered, moves an electromagnetic core (12) which moves a plate (11) that moves to place the lever (7) of the electrical contact (21) in its normal operating position.

Figure 4:
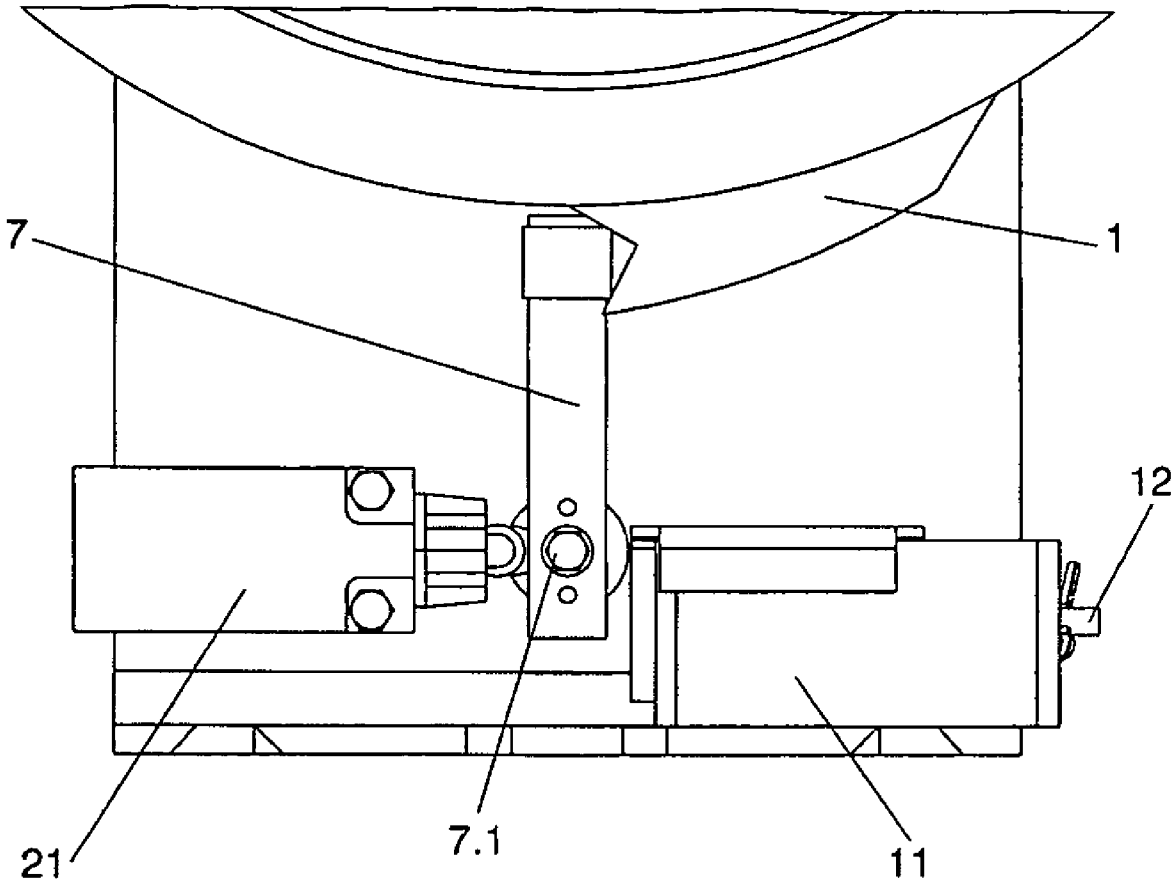
FIG. 4 shows details of the remote resetting means and the electrical parts that generate an excess speed signal.
Figure 5A:
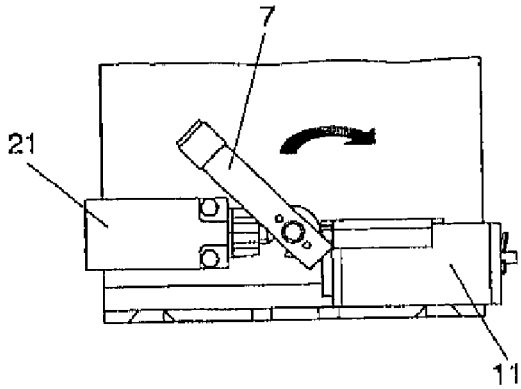
FIGS. 5*a*, 5*b*, 5*c* and 5*d* the sequence for operating on the speed limiting means and specifically the resetting means showing how a single coil can be used to recover the initial position.
Figure 5B:
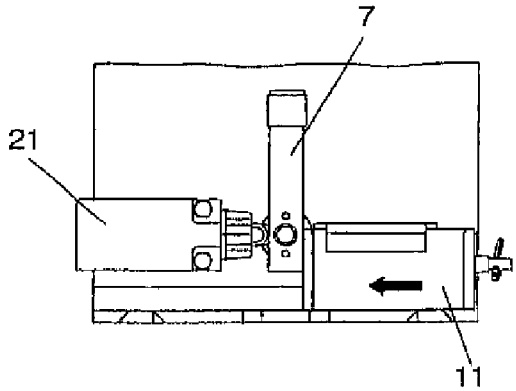
Figure 5C:
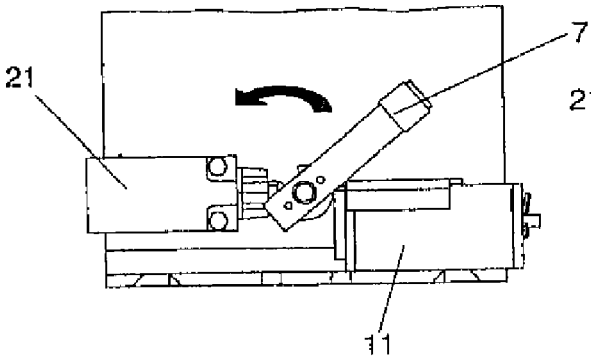
Figure 5D:
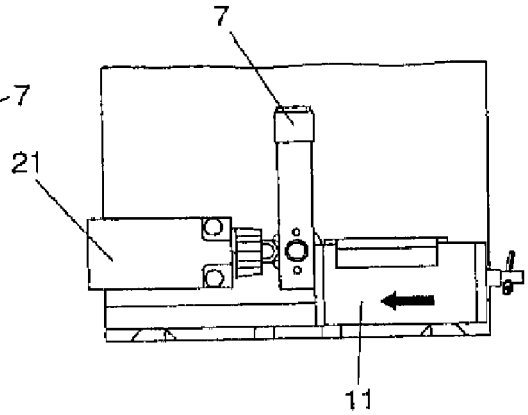
Figure 6A:
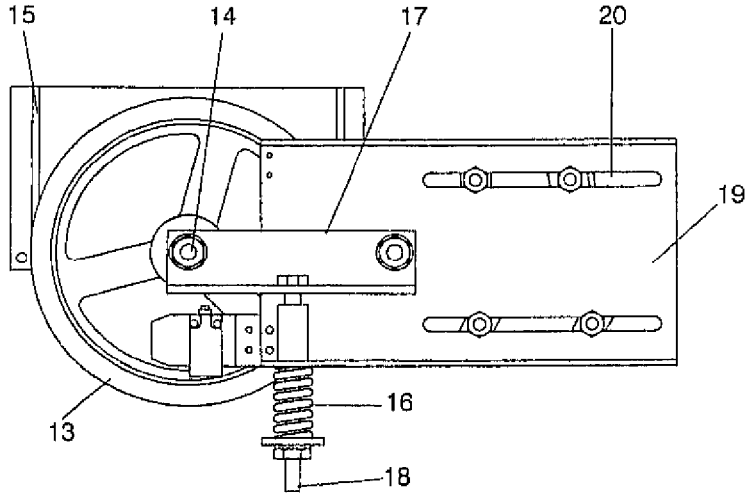
FIGS. 6*a*, 6*b*, 7*a* and 7*b* show the elevation and plan of the two possible means used to regulate the tension of the speed limiter system.
Figure 6B:
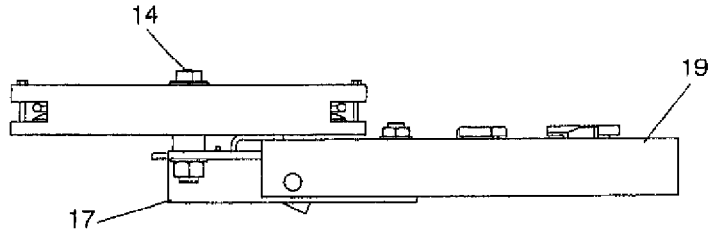

FIG. 4 shows in more detail the lever (7) that has a point of rotation (7.1) with respect to which it pivots, operated by one of the weights (1), opening or closing the electrical contact (21). The lever (7) is reset by the resetting assembly (14) consisting of a coil which, when powered, moves a core (12) that moves a plate (11) that places the lever (7) of the electrical contact in its original position.

Thus it is not necessary to access the lift shaft if the limiter is located in the shaft.

FIGS. 5*a*, 5*b*, 5*c* and 5*d* show the sequence of actions that are carried out on the lever (7), depending on the direction of rotation of the speed limiter, the lever (7) is rotated to the left or to the right but independently of its direction of rotation, thanks to the coil (10) the lever (7) is reset to its original position, there being only one resetting mechanism and not one for each direction of rotation of the speed limiter. F*ig*. 6 shows the Tension pulley (13) that provides sufficient tension to the sections of cable (15) so that the brake can operate perfectly if necessary.

The tension on the cable (15) is transmitted via the tension pulley (13) which in turn receives this tension from a compression spring (16) via a support plate (17) fixed to the axle (14) of the pulley (13).

The tension pulley (13) is anchored to the guide by a plate (19), this plate (19) having lengthened holes (20) in which are fixed the flanges to support the guides which in turn fix the tension system.

Figure 7A:
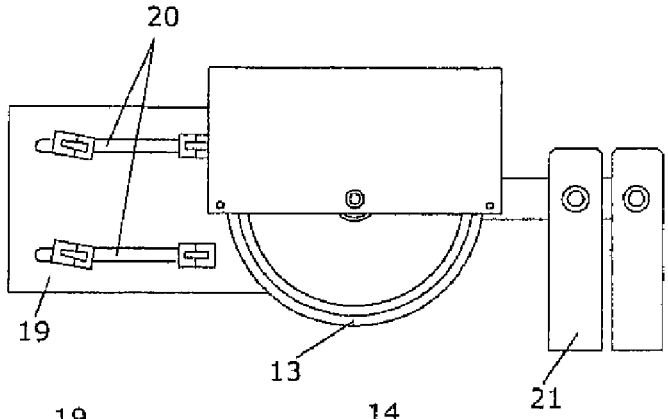
Figure 7B:
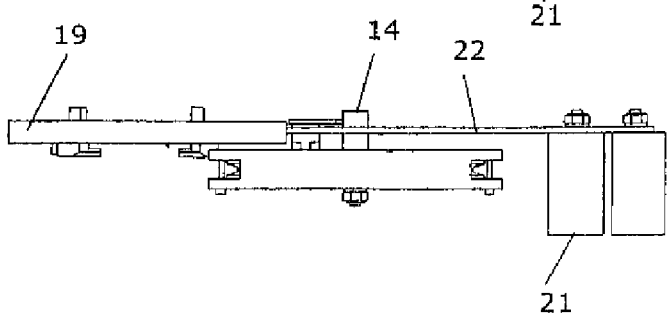

FIG. 7*a* and 7*b* show that the way in which a sufficient tension is provided to the tension pulley (13) consists of an arm (22) that is articulated at one of its ends to the plate (19) and on which the pulley (13) axle (14) is fixed, this arm (22) having weights (21) fixed to its other end.

The essential nature of this invention is not changed by the use of different materials, form, size and layout of the component elements, described without limitation, and based on its reproduction by an expert.

The invention claimed is:

1. Speed limiter system for lifting devices, among systems for detecting over speeds, that comprises a main part which is the speed limiter itself and a tension pulley in which the speed limiter comprises two weights that pivot with respect to a fixed point and that are joined at their ends by connections to an arm that pivots on another fixed point, both moving symmetrically and with means of adjusting the speed of action through a spring, one end of which is joined to one of the weights and the other to a mobile piece that is adjusted by a tension screw, characterised in that electrical means are associated with the speed limiter to generate an over speed signal, as well as means for remotely resetting that return the electrical means to a position independently of the direction of rotation in which the electrical means have been operated and in which the tension pulley provides the sufficient tension on the cable so that in the event of an over speed, brakes operate correctly.

2. Speed limiter system for lifting devices, as in claim 1, characterised in that the electrical means for generating the over speed signal comprise an electrical contact associated with an articulated lever at one of its ends while the other end is operated by the centrifugal movement of one of the weights.

3. Speed limiter system for lifting devices, as in claim 2, characterised in that the means for resetting the electrical means comprise. a coil, an electromagnetic core moved by the powering of the coil, and which in its movement drags a plate that returns the lever of the electrical contact, to its original position.

4. Speed limiter system for lifting devices, as in claim 1, characterised in that the tension pulley has as the means to provide it with sufficient tension, a compression spring fixed at one of its ends to a support plate that transmits the tension of the spring via the axle of the pulley; and a screw for adjusting the tension of the spring, and the tension pulley is fixed to guides by a plate with lengthened holes in which support flanges are fitted.

5. Speed limiter system for lifting devices, as in claim 1, characterised in that the tension pulley has as a means to provide it with sufficient tension, an arm that is articulated at one of its end to plate and on which the pulley axle is fixed, this arm having weights suspended at its other end.

6. A speed limiter system for lifting devices comprising a speed limiter and a tension pulley, the speed limiter comprising:

a first weight pivotable about a first point;

a second weight pivotable about a second point;

an arm connecting the first weight to the second weight, the arm being pivotable about a third point;

a spring having a first end connected to the first weight and a second end connected to a mobile piece;

a tension screw connected to the mobile piece for adjusting the position of the mobile piece;

a controller for generating an over speed signal; a lever operably connected to the controller and shiftable by the first weight or the second weight from a neutral position to a first over speed position or from the neutral position to a second over speed position with respect to the controller, whereby the controller generates an over speed signal when the lever is shifted to the first or second over speed position; and a piston mounted adjacent to the lever for pushing the lever to the neutral position from the first over speed position and for pushing the lever to the neutral position from the second over speed position.

7. The speed limiter of claim 6 wherein said piston comprises an electrically actuated piston.

8. The speed limiter of claim 7 wherein said piston is mounted such that movement of said piston from a first position to a reset position shifts said lever to the neutral position from said first over speed position and from said second over speed position.

9. A speed limiter system for lifting devices comprising a speed limiter and a tension pulley, the speed limiter comprising:

a first weight pivotable about a first point;

a second weight pivotable about a second point;

an arm connecting the first weight to the second weight, the arm being pivotable about a third point;

a spring having a first end connected to the first weight and a second end connected to a mobile piece;

a tension screw connected to the mobile piece for adjusting the position of the mobile piece;

over speed signal generating means for generating an over speed signal, said over speed signal generating means including an element shiftable in a first direction from a neutral position to a first over speed position and in a second direction from the neutral position to a second over speed position; and reset means for resetting said over speed signal generating means, said reset means comprising a reset component shiftable from a first position to a reset position, the reset component shifting said element to the neutral position by moving from the first position to the reset position.

* * * * *